US008384603B2

(12) United States Patent
Kim et al.

(10) Patent No.: US 8,384,603 B2
(45) Date of Patent: Feb. 26, 2013

(54) PCB AND EMBEDDED ANTENNA FOR MOBILE COMMUNICATION TERMINAL HAVING DOUBLE FEED POINTS USING THE SAME

(75) Inventors: Chi Sun Kim, Seongnam-si (KR); Chang Won Jang, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 989 days.

(21) Appl. No.: 11/935,231

(22) Filed: Nov. 5, 2007

(65) Prior Publication Data

US 2008/0174511 A1 Jul. 24, 2008

(30) Foreign Application Priority Data

Nov. 6, 2006 (KR) ..... 2006-0108975

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 6,806,834 B2 * 10/2004 Yoon ..... 343/702
7,671,804 B2 * 3/2010 Zhang et al. ..... 343/700 MS
2005/0280587 A1 * 12/2005 Svigelj et al. ..... 343/702
2007/0001906 A1 * 1/2007 Pelzer et al. ..... 343/700 MS

* cited by examiner

*Primary Examiner* — Robert Karacsony
(74) *Attorney, Agent, or Firm* — The Farrell Law Firm, P.C.

(57) ABSTRACT

A Printed Circuit Board (PCB) and an embedded antenna for a mobile communication terminal having double feed points using the same are provided. The embedded antenna includes a PCB having an emission carrier. The emission carrier includes first and second feed points connected to a feed wiring layer of the PCB, as well as an emission pattern to which the feed points are connected. The feed wiring layer supplies a current to one of the feed points, and has a connection wiring for supplying a current from the feed point to the other feed point. Through overlapping between a first resonance spot created by the first feed point, and a second resonance spot, which branches off from the first feed point and connects to the PCB, the frequency bandwidth can be expanded, which accommodates any frequency shift minimizes deterioration resulting from the influence of human bodies, and maintains stable antenna characteristics.

12 Claims, 7 Drawing Sheets

PCB AND EMBEDDED ANTENNA FOR MOBILE COMMUNICATION TERMINAL HAVING DOUBLE FEED POINTS USING THE SAME

PRIORITY

This application claims priority under 35 §U.S.C. 119(a) to an application entitled "PCB AND EMBEDDED ANTENNA FOR MOBILE COMMUNICATION TERMINAL HAVING DOUBLE FEED POINTS USING THE SAME" filed in the Korean Intellectual Property Office on Nov. 6, 2006 and assigned Ser. No. 2006-0108975, the contents of which are incorporated herein by reference.

BACKGROUND OF THE INVENTION

1. Field of the invention

The present invention relates generally to an antenna for a mobile communication terminal, and more particularly to a Printed Circuit Board (PCB) contained in a case and an embedded antenna for a mobile communication terminal having double feed points using the same.

2. Description of the Prior Art

As generally known in the art, current mobile communication terminals are expected to provide more services, in addition to satisfying requests for compactness and lightness. In order to satisfy such requests, internal circuits and components for mobile communication terminals are becoming smaller while incorporating more functions. Such a trend is no exception in the case of antennas, which are one of the major components of mobile communication terminals.

Considering this, it has been proposed to install antennas inside the case of mobile communication terminals (i.e. embedded antennas).

FIG. 1 is an exploded perspective view of an embedded antenna 100 for a mobile communication terminal, which has a single feed point 33, according to the prior art. FIG. 2 is a perspective view of the embedded antenna 100 shown in FIG. 1. Referring to FIGS. 1 and 2, the conventional embedded antenna 100 includes a case 10, a PCB 20 contained in the case 10, and an emission carrier 30 formed in a planar shape at a predetermined distance from the upper surface of the PCB 20.

The emission carrier 30 includes a dielectric plate 31 and an emission wiring layer 32 formed on a surface of the dielectric plate 31. The emission wiring layer 32 includes a feed point 33 and a ground point 35 formed on the lower surface of the dielectric plate 31 while being adjacent to each other, an emission pattern 36 formed on the upper surface of the dielectric plate 31, and a connection pattern 38 connecting the feed and ground points 33 and 35 to the emission pattern 36, respectively. The emission pattern 36 has a U-slot 37 formed therein so as to implement a dual band.

The PCB 20 includes an insulative body 21 and a feed wiring layer 22 formed on the body 21. The feed wiring layer 22 includes a ground layer 23 formed on the lower surface 21*a* of the body 21, as well as a feed pad 24 and a ground pad 27 formed on the upper surface 21*b* of the body 21. The ground pad 27 is connected to the ground layer 23. The feed and ground points 33 and 35 are connected to the feed and ground pads 24 and 27 via connection tips 28, respectively.

When a current is supplied to the feed point 33 connected to the feed pad 24 of the conventional embedded antenna 100, it flows through the connection pattern 38 and the emission pattern 36 so that electromagnetic waves in a dual frequency band are emitted.

However, the conventional embedded antenna 100 has a limitation in that, since a single feed point 33 emits electromagnetic waves via a two-dimensional emission pattern 36, the frequency bandwidth of emitted electromagnetic waves is narrow, as shown in FIG. 3. This is an obstacle to expanding the frequency bandwidth. Particularly, the conventional embedded antenna 100 has narrowband characteristics in the low-frequency band, i.e. 837-903 MHz (7.06%) at a bandwidth of −10 dB.

Considering that users commonly grasp the case 40 of their mobile communication terminals by hand and place it on their ear during use, a frequency shift may be caused by the influence of human bodies, as shown in FIG. 4. The frequency shift may result in deviation from the narrow frequency bandwidth of the conventional embedded antenna 100. In this case, the embedded antennas 100 may deteriorate and fail to function properly. More particularly, in the case of the conventional embedded antenna 100, spots "1" and "2" belong to a Code Division Multiple Access (CDMA) band of 824-894 MHz. The resonance spots may shift towards the low-frequency region under the influence of human bodies and eventually deviate from the CDMA band.

SUMMARY OF THE INVENTION

Accordingly, the present invention has been made to solve the above-mentioned problems occurring in the prior art, and the present invention provides an embedded antenna having an expanded frequency bandwidth.

The present invention also provides an embedded antenna, the deterioration in performance of which is minimized even if a frequency shift is caused by the influence of human bodies, so that stable antenna performance is maintained.

In accordance with one aspect of the present invention, there is provided an embedded antenna for a mobile communication terminal having double feed points, the embedded antenna including a Printed Circuit Board (PCB) having a feed wiring layer formed thereon, and an emission carrier positioned at a predetermined distance from an upper surface of the PCB, the emission carrier having a first feed point, a second feed point, and a ground point connected to the feed wiring layer. The feed wiring layer supplies a current to one of the first and second feed points, and the feed wiring layer has a connection wiring for supplying a current from a feed point, which has been supplied with a current, to the other feed point.

The feed wiring layer includes a ground layer formed on a lower surface of the PCB; a first feed pad formed on the upper surface of the PCB, the first feed point being connected to the first feed pad; a second feed pad formed on the upper surface of the PCB, the second feed point being connected to the second feed pad; a connection wiring for connecting the first feed pad to the second feed pad; and a ground pad formed on the upper surface of the PCB while being connected to the ground layer, the ground point being connected to the ground pad. The connection wiring is formed on the upper surface of the PCB.

The emission carrier is formed on a portion of the upper surface of the PCB. The connection wiring is formed to extend near a periphery of the upper surface of the PCB.

The emission carrier includes a dielectric plate, and an emission wiring layer formed on a surface of the dielectric plate. The emission wiring layer includes first and second feed points formed on both sides of a lower surface of the dielectric plate; a ground point formed adjacent to one of the first and second feed points; an emission pattern formed on an upper surface of the dielectric plate; and a connection pattern for connecting the first feed point, the second feed point, and the ground point to the emission pattern, respectively.

The first feed point, the second feed point, and the ground point are formed adjacent to a lateral surface of the dielectric plate, and the connection pattern is formed on the lateral surface of the dielectric plate. The emission pattern has a U-slot formed therein.

In accordance with another aspect of the present invention, there is provided a PCB for an embedded antenna of a mobile communication terminal having double feed points, the PCB including a body, and a feed wiring layer formed on the body, an emission carrier being connected to the feed wiring layer. The feed wiring layer includes a ground layer formed on a lower surface of the body; a first feed pad formed on an upper surface of the body, a first feed point of the emission carrier being connected to the first feed pad; a second feed pad formed on the upper surface of the body, a second feed point of the emission carrier being connected to the second feed pad; a connection wiring formed on the upper surface of the body so as to connect the first feed pad to the second feed pad; and a ground pad formed on the upper surface of the body while being connected to the ground layer, the ground pad being connected to a ground point of the emission carrier.

A current is supplied to one of the first and second feed pads.

The ground pad is formed adjacent to a feed pad, to which a current is supplied.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENTS

Figure 1:
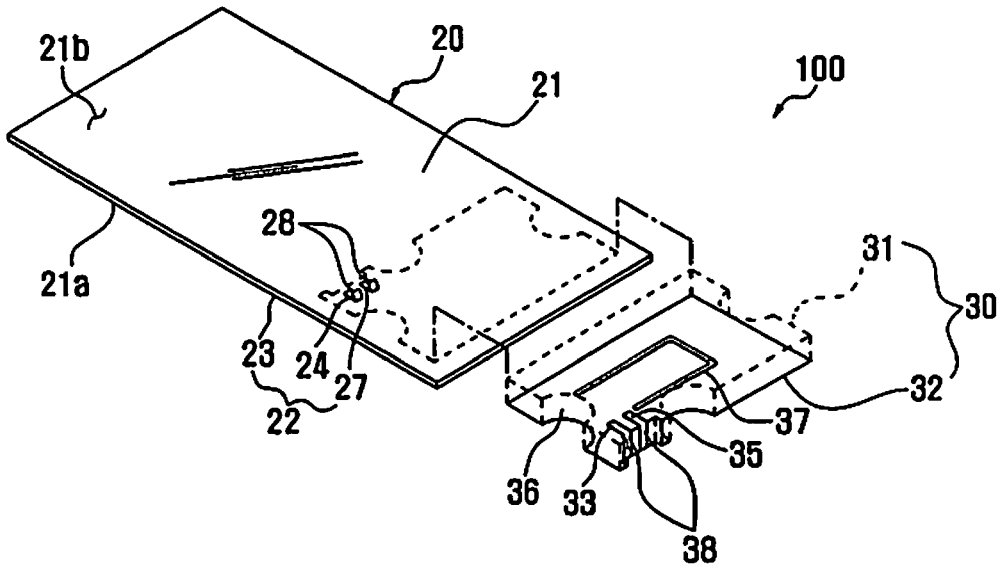
FIG. 1 (PRIOR ART)
FIG. 1 is an exploded perspective view of an embedded antenna for a mobile communication terminal having a single feed point according to the prior art.
Figure 2:
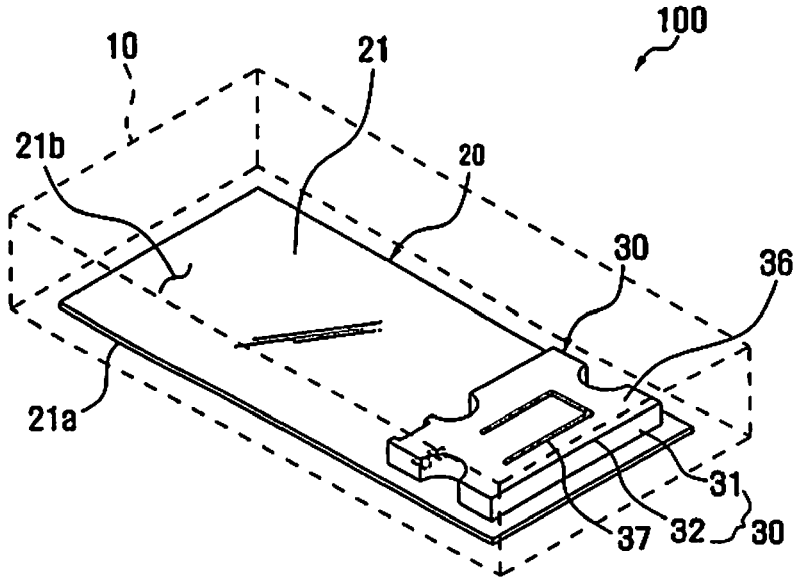
FIG. 2 (PRIOR ART)
FIG. 2 is a perspective view of the embedded antenna shown in FIG. 1.

Advantages and features of the present invention, and ways to achieve them will be apparent from embodiments of the present invention are described below together with the accompanying drawings. However, the scope of the present invention is not limited to such embodiments and the present invention may be realized in various forms. The embodiments described below are provided to assist those skilled in the art to completely understand the present invention. The present invention is defined only by the scope of the appended claims. Also, the same reference numerals are used to designate the same elements throughout the specification.

Hereinafter, exemplary embodiments of the present invention will be described with reference to the accompanying drawings.

Figure 5:
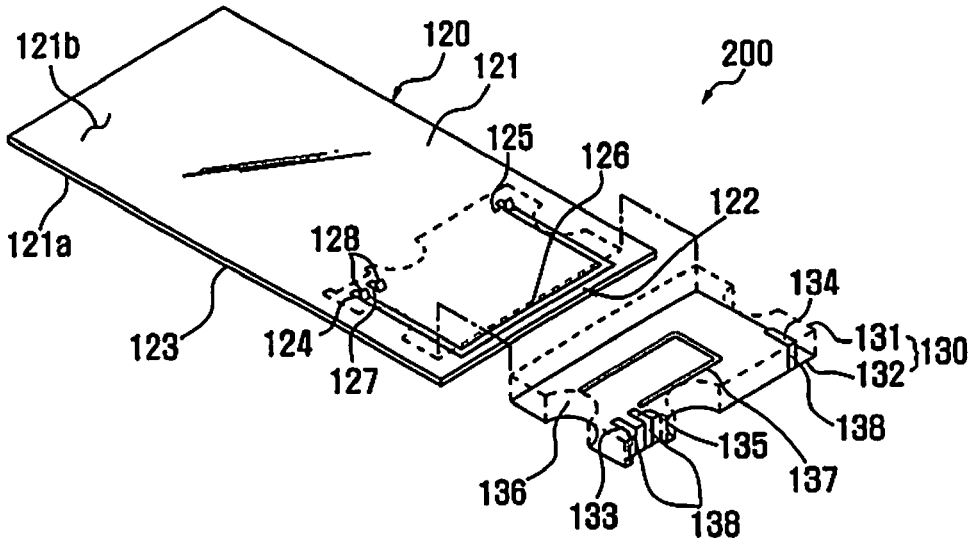
FIG. 5 is an exploded perspective view of an embedded antenna for a mobile communication terminal having double feed points according to an embodiment of the present invention.
Figure 6:
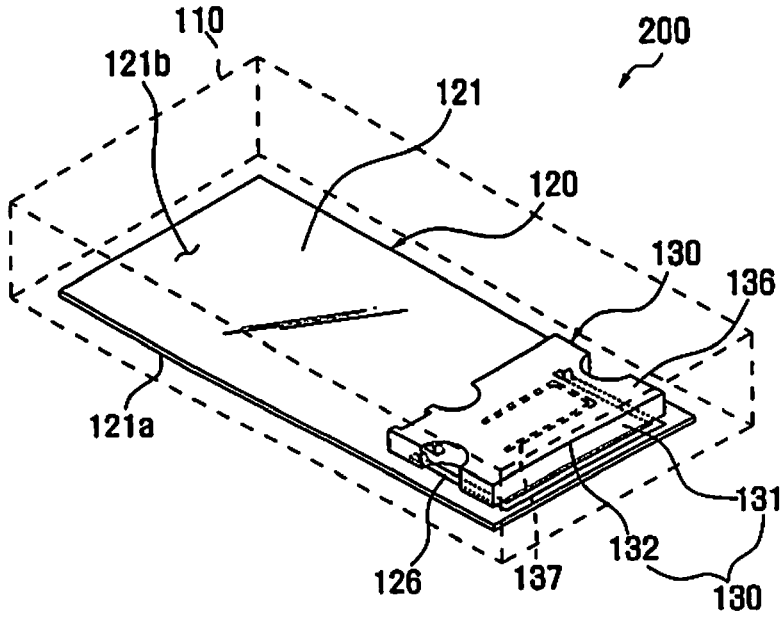
FIG. 6 is a perspective view of the embedded antenna shown in FIG. 5.
Figure 7:
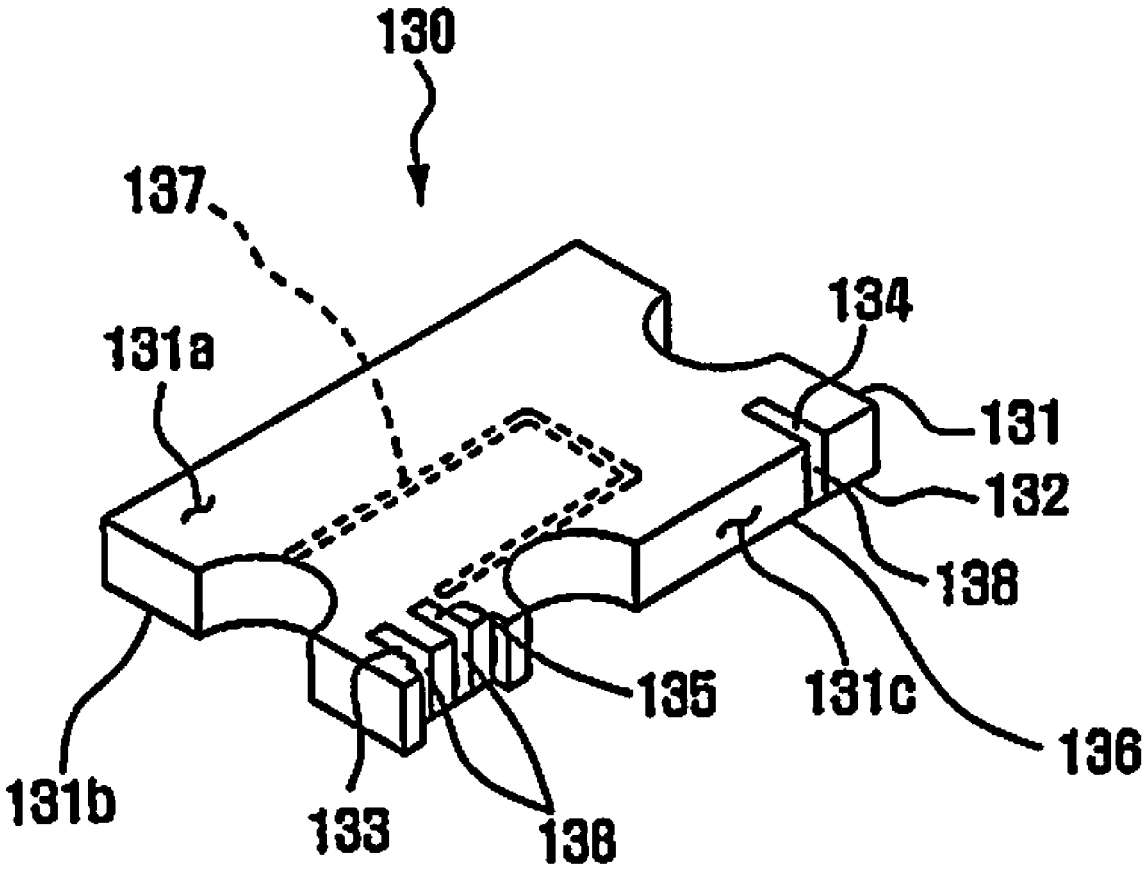
FIG. 7 is a perspective view showing the bottom of an emission carrier shown in FIG. 5.

FIG. 5 is an exploded perspective view of an embedded antenna 200 for a mobile communication terminal having double feed points 133 and 134 according to an embodiment of the present invention. FIG. 6 is a perspective view of the embedded antenna 200 shown in FIG. 5. FIG. 7 is a perspective view showing the bottom of an emission carrier 130 shown in FIG. 5.

Referring to FIGS. 5 and 6, the embedded antenna 200 for a mobile communication terminal includes a case 110, a PCB 120 contained in the case 110, and an emission carrier 130 formed in a planar shape at a predetermined distance from the upper surface of the PCB 120. The PCB 120 has a feed wiring layer 122 formed thereon. The emission carrier 130 has an emission wiring layer 132 connected to the feed wiring layer 122.

The emission wiring layer 132 has first and second feed points 133 and 134, as well as a ground point 135 formed adjacent to one of the first and second feed points 133 and 134. Particularly, the feed wiring layer 122 initially supplies a current to one of the first and second feed points 133 and 134, and has a connection wiring 126 for supplying the current from the former feed point to the other. According to the present embodiment, the feed wiring layer 122 initially supplies a current to the first feed point 133, and then to the second feed point 134 via the connection wiring 126 which connects the first and second feed points 133 and 134 to each other.

The embedded antenna 200 according to the present embodiment has a pattern connected to the emission carrier 130 via the first feed point 133, and another pattern branching off from the first feed point 133 and connecting to the emission carrier 130 via the second feed point 134 (i.e. loop structure). As such, the embedded antenna 200 according to the present embodiment expands the frequency bandwidth by taking advantage of the effect of overlapping between a first resonance spot, which is created by the first feed point 133, and a second resonance spot, which is created by the connection wiring 126 and the second feed point 134. As a result, the extended frequency band accommodates any frequency shift occurring under the influence of human bodies. This minimizes the deterioration in performance of the embedded antenna 200 resulting from the influence of human bodies and maintains stable antenna performance.

The embedded antenna 200 according to an embodiment of the present invention will now be described in more detail.

The PCB 120 includes a body 121 having lower and upper surfaces 121*a* and 121*b*, and a feed wiring layer 122 formed on the body 121. Although the PCB 120 has a number of components mounted thereon in addition to the emission carrier 130, the components are not indispensable to understanding of the embedded antenna 200, so their description and illustration will be omitted herein.

The body 121 is a square insulating plate having a predetermined depth, and has an emission carrier 130 formed on a portion of its upper surface 121*b*. The body 121 may be made of prepreg, epoxy resin containing glass fibers, or Bismaleimide Triazine (BT) resin.

The feed wiring layer 122 is made of copper, and is formed by attaching copper foil to the body 121 and patterning it through a photo etching process. The feed wiring layer 122 includes a ground layer 123 formed on the lower surface 121*a* of the body 121, first and second feed pads 124 and 125 formed on the upper surface 121*b* of the body 121, a connection wiring 126, and a ground pad 127.

The first feed pad 124 is connected to the first feed point 133 of the emission carrier 130. The second feed pad 125 is connected to the second feed point 134 of the emission carrier 130. The connection wiring 126 connects the first and second feed pads 124 and 125 to each other. The ground pad 127 is connected to the ground layer 123, as well as to the ground point 135 of the emission carrier 130. The ground pad 127 is formed adjacent to the first feed pad 124. The first feed pad 124, the second feed pad 125, and the ground pad 127 have connection tips 128 formed thereon, respectively, so that the emission carrier 130 can be stably installed on the PCB 120. The ground pad 127 is connected to the ground layer 123 by way of a via (not shown), which extends through the body 121.

The emission carrier 130 includes a planar dielectric plate 131 and an emission wiring layer 132 formed on a surface of the dielectric plate 131. The dielectric plate 131 may be made of epoxy resin containing glass fibers. The emission wiring layer 132 includes a first feed point 133, a second feed point 134, a ground point 135, an emission pattern 136, and a connection pattern 138. The first and second feed points 133 and 134 are formed on both sides of the lower surface 131*a* of the dielectric plate 131. The ground point 135 is formed adjacent to one of the first and second feed points 133 and 134, particularly to the first feed point 133 according to the present embodiment. The emission pattern 136 is formed on the upper surface 131*b* of the dielectric plate 131. The connection pattern 138 connects the first feed point 133, the second feed point 134, and the ground point 135 to the emission pattern 136. The first feed point 133, the second feed point 134, and the ground point 135 are formed adjacent to a lateral surface 131*c* of the dielectric plate 131. The connection pattern 138 is formed on the lateral surface 131*c* of the dielectric plate 131. The emission pattern 136 has a U-slot 137 formed therein so as to implement a dual band. As used herein, the dual band refers to a combination of a CDMA band of 824-894 MHz and a Personal Communications Services (PCS) band of 1.85-1.99 GHz.

In particular, the emission carrier 130 is formed on a portion of the upper surface 121*a* of the body 121. The connection wiring 126 is formed so as to extend near a periphery of the upper surface 121*a* of the body 121. Based on positioning of the second feed point 134 relative to the first feed point 133 and adjustment of length of the connection wiring 126, the frequency bandwidth in the low-frequency band can be expanded.

The embedded antenna 200 according to the present invention will now be compared with a conventional embedded antenna with reference to a Smith chart, when the antennas are in the air, particularly with regard to S11 parameter characteristics.

Figure 3:
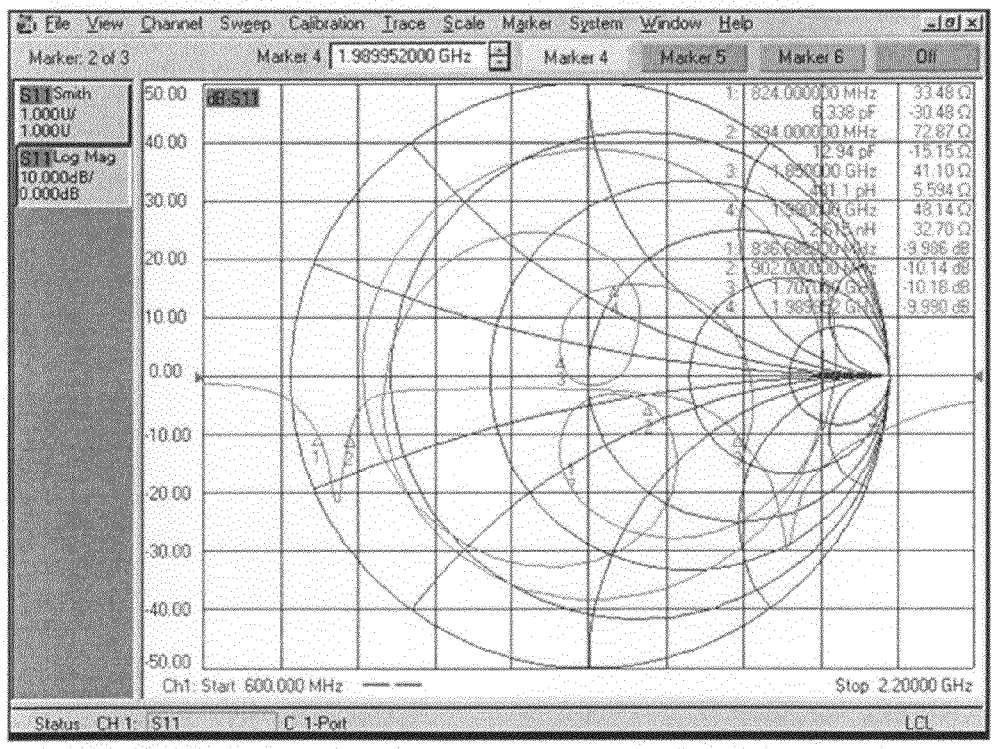
FIG. 3 is a Smith chart of a mobile communication terminal having the embedded antenna shown in FIG. 2 when the terminal is in the air.

The conventional embedded antenna having a single feed point, as shown in FIG. 3, has narrowband characteristics in the low-frequency band, i.e. 837-903 MHz (7.06%) at a bandwidth of −10 dB. In this case, −10 dB bandwidth in the low-frequency band is 66 MHz, and the central frequency is 867 MHz.

Figure 8:
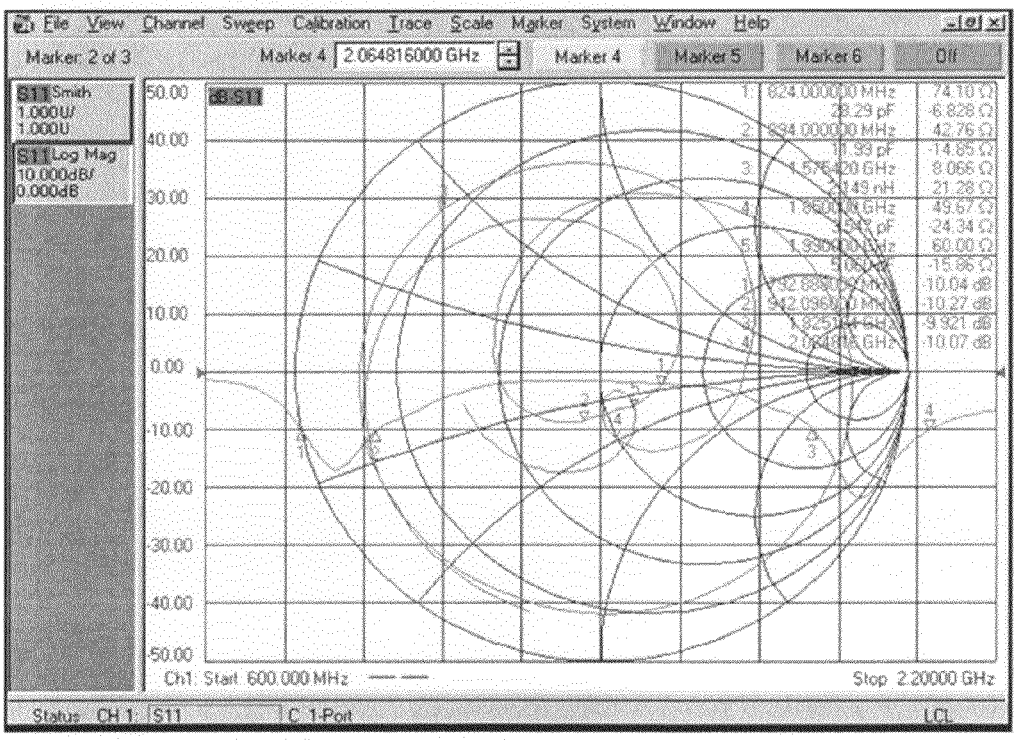
FIG. 8 is a Smith chart of a mobile communication terminal having the embedded antenna shown in FIG. 6 when the terminal is in the air.

In contrast, the embedded antenna 200 having double feed points 133 and 134 according to the present invention, as shown in FIG. 8, has wideband characteristics in the low-frequency band, i.e. 793-942 MHz (17.2%) at a bandwidth of −10 dB, which doubles the conventional bandwidth. In this case, −10 dB bandwidth in the low-frequency band is 149 MHz, and the central frequency is 868 MHz. It is to be noted that −10 dB bandwidth in the low-frequency band includes a CDMA band of 824-894 MHz.

The embedded antenna 200 according to the present invention will now be compared with a conventional embedded antenna with reference to a Smith chart, when the mobile communication terminals incorporating the antennas are grasped by hand, particularly with regard to S11 parameter characteristics.

Figure 4:
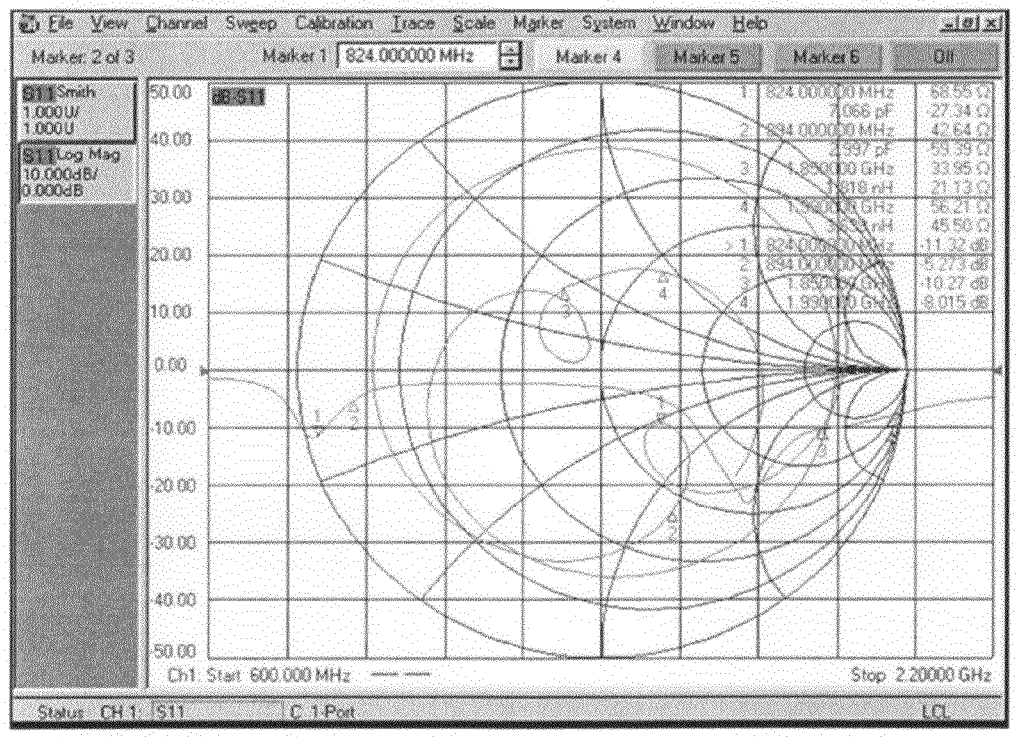
FIG. 4 is a Smith chart of a mobile communication terminal having the embedded antenna shown in FIG. 2 when the terminal is grasped by hand.

It is clear from FIG. 4 that, in the case of the conventional embedded antenna having a single feed point, a frequency shift resulting from the influence of human bodies causes deviation from the CDMA band. Spots "1" and "2" designate dB values in the lower and upper limits of the CDMA band, respectively. More particularly, spot "1" corresponds to −11.32 dB at 824 MHz, and spot "2" corresponds to −5.272 dB at 894 MHz.

Figure 9:
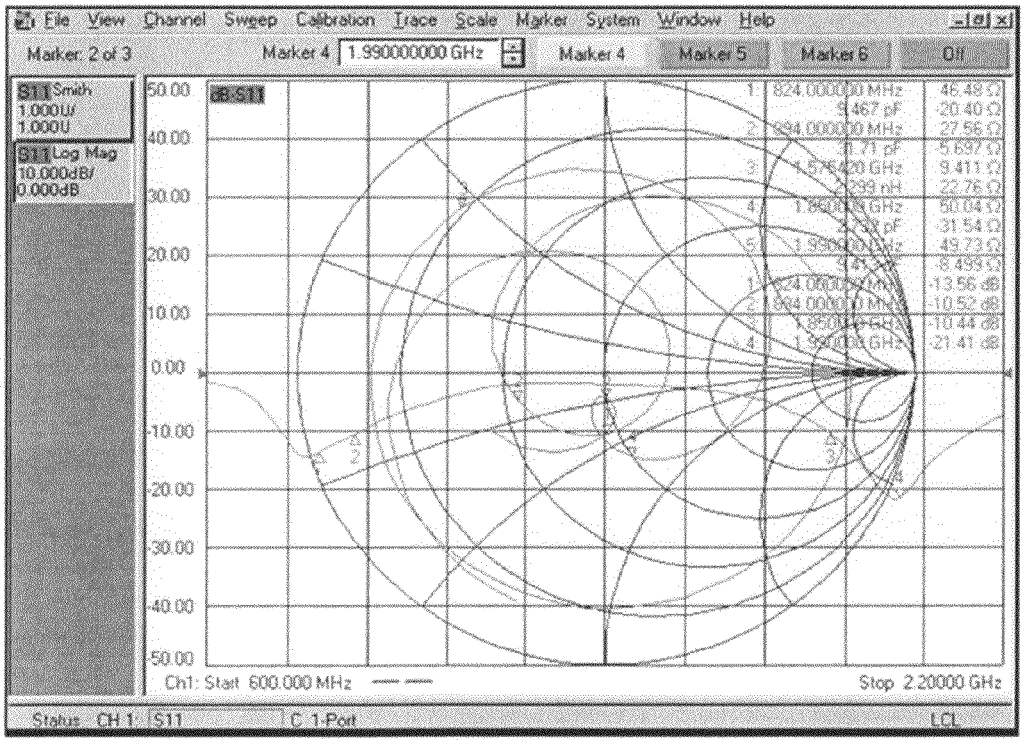
FIG. 9 is a Smith chart of a mobile communication terminal having the embedded antenna shown in FIG. 6 when the terminal is grasped by hand.

In contrast, it is clear from FIG. 9 that, in the case of the embedded antenna 200 having double feed points 133 and 134 according to the present invention, the CDMA band falls into −10 dB bandwidth. Particularly, spot "1" corresponds to −13.56 dB at 824 MHz, and spot "2" corresponds to −10.52 dB at 894 MHz.

Although a frequency shift occurs when a mobile communication terminal having the embedded antenna 200 according to the present invention is grasped by hand, the expanded bandwidth includes the CDMA band. More particularly, resonance spots are shifted when the terminal is grasped by hand. The first resonance spot created by the first feed point 133 deviates from the CDMA band, but the second resonance spot created by the second resonance spot 134 approaches 500, overlaps the first resonance spot, and includes the CDMA band.

As mentioned above, the present invention is advantageous in that the frequency bandwidth is extended by taking advantage of overlapping between a first resonance spot, which is created by a first feed point, and a second resonance spot, which is created by a second feed point branching off from the first feed point and connecting to a connection wiring formed on the PCB.

The extended frequency band accommodates any frequency shift resulting from the influence of human bodies. This minimizes the deterioration in performance of the embedded antenna resulting from the influence of human bodies, and maintains stable antenna performance.

Based on positioning of the second feed point relative to the first feed point and adjustment of length of the connection wiring, the degree of overlapping between the first and second resonance spots is adjusted, and so is the wideband-oriented frequency bandwidth.

The effects of the present invention are not limited to the above-mentioned effects, and other effects not mentioned above can be clearly understood from the definitions in the claims by one skilled in the art.

Although exemplary embodiments of the present invention have been described for illustrative purposes, those skilled in the art will appreciate that various modifications, additions and substitutions are possible, without departing from the scope and spirit of the invention as disclosed in the accompanying claims. Therefore, the embodiments described above should be understood as illustrative not restrictive in all aspects. The present invention is defined only by the scope of the appended claims and must be construed as including the meaning and scope of the claims, and all changes and modifications derived from equivalent concepts of the claims.

What is claimed is:

1. An embedded antenna for a mobile communication terminal having double feed points, the embedded antenna comprising:

a Printed Circuit Board (PCB) having a feed wiring layer formed thereon; and an emission carrier positioned at a predetermined distance from an upper surface of the PCB, the emission carrier having a first feed point, a second feed point, and a ground point connected to the feed wiring layer, wherein the feed wiring layer supplies a current to the first feed point and then supplies the current to the second feed point, wherein the feed wiring layer has a connection wiring that supplies the current received from the first feed point to the second feed point and that supplies the current received from the second feed point to the first feed point, and wherein the emission carrier comprises an emission pattern having a slot formed therein and a connection pattern for connecting the first feed point, the second feed point, and the ground point to the emission pattern, respectively.

2. The embedded antenna of claim 1, wherein the feed wiring layer comprises:

a ground layer formed on a lower surface of the PCB;

a first feed pad formed on the upper surface of the PCB, the first feed point being connected to the first feed pad;

a second feed pad formed on the upper surface of the PCB, the second feed point being connected to the second feed pad;

said connection wiring for connecting the first feed pad to the second feed pad; and a ground pad formed on the upper surface of the PCB while being connected to the ground layer, the ground point being connected to the ground pad.

3. The embedded antenna of claim 2, wherein the connection wiring is formed on the upper surface of the PCB.

4. The embedded antenna of claim 3, wherein the emission carrier is formed on a portion of the upper surface of the PCB.

5. The embedded antenna of claim 4, wherein the connection wiring is formed to extend near a periphery of the upper surface of the PCB.

6. The embedded antenna of claim 5, wherein the emission carrier comprises:

a dielectric plate; and an emission wiring layer formed on a surface of the dielectric plate, and the emission wiring layer comprises:

the first and second feed points formed on both sides of a lower surface of the dielectric plate;

the ground point formed adjacent to the first and second feed points;

the emission pattern formed on an upper surface of the dielectric plate; and the connection pattern.

7. The embedded antenna of claim 6, wherein the first feed point, the second feed point, and the ground point are formed adjacent to a lateral surface of the dielectric plate, and the connection pattern is formed on the lateral surface of the dielectric plate.

8. The embedded antenna of claim 7, wherein the slot of the emission pattern is a U-shaped slot formed therein.

9. A Printed Circuit Board (PCB) for an embedded antenna of a mobile communication terminal having double feed points, the PCB comprising:

a body; and a feed wiring layer formed on the body, with an emission carrier being connected to the feed wiring layer and comprising an emission pattern having a slot formed therein and a connection pattern for connecting a first feed point, a second feed point, and a ground point to the emission pattern, respectively, wherein the feed wiring layer comprises:

a ground layer formed on a lower surface of the body;

a first feed pad formed on an upper surface of the body, a first feed point of the emission carrier being connected to the first feed pad;

a second feed pad formed on the upper surface of the body, a second feed point of the emission carrier being connected to the second feed pad;

a connection wiring formed on the upper surface of the body so as to connect the first feed pad to the second feed pad; and a ground pad formed on the upper surface of the body while being connected to the ground layer, the ground pad being connected to the ground point of the emission carrier, and wherein a current is supplied from the feed wiring layer to the first feed pad and then from the feed wiring layer to the second feed pad, and wherein the connection wiring supplies the current received from the first feed point to the second feed point and supplies the current received from the second feed point to the first feed point.

10. The PCB of claim 9, wherein the ground pad is formed adjacent to the first and second feed pads.

11. The PCB of claim 10, wherein the feed wiring layer is formed on a portion of the upper surface of the body, the emission carrier being positioned on the portion.

12. The PCB of claim 11, wherein the connection wiring is formed so as to extend adjacent to a periphery of the upper surface of the body.

* * * * *